US005672078A

United States Patent [19]

Fukamachi et al.

[11] Patent Number: 5,672,078

[45] Date of Patent: Sep. 30, 1997

[54] CONNECTOR

[75] Inventors: Makoto Fukamachi; Hajime Kawase, both of Yokkaichi, Japan

[73] Assignee: Sumitomo Wiring Systems, Ltd., Japan

[21] Appl. No.: 510,492

[22] Filed: Aug. 2, 1995

[30] Foreign Application Priority Data

Aug. 22, 1994 [JP] Japan ..... 6-221033
Aug. 25, 1994 [JP] Japan ..... 6-225959

[51] Int. Cl.[6] ..... H01R 13/502

[52] U.S. Cl. ..... 439/701; 439/902

[58] Field of Search ..... 439/701, 902, 439/466, 473, 599

[56] References Cited

U.S. PATENT DOCUMENTS 4,290,664 9/1981 Davis et al. .
4,786,261 11/1988 Ramos, Jr. .
4,973,266 11/1990 Bullard .
5,271,739 12/1993 Denlinger et al. ..... 439/902
5,295,859 3/1994 Kawai et al. .
5,312,268 5/1994 Sumida .

FOREIGN PATENT DOCUMENTS 546 642 A1 6/1993 European Pat. Off. .
4-274180 9/1992 Japan .
4-129477 11/1992 Japan .
2 260 658 4/1993 United Kingdom .

*Primary Examiner*—Khiem Nguyen
*Assistant Examiner*—Yong Ki Kim
*Attorney, Agent, or Firm*—Banner & Witcoff, Ltd.

[57] ABSTRACT

A split connector comprises an open frame 2 having apertures 8 into which female housings 1 are inserted against abutments 6. Cut-away windows 14 are formed in the two side walls 9, and clamping members 15 are able to open and close via self-hinges 20. After the female housings 1 have been inserted into the apertures 8 the clamping members 15 are pivoted and locked to retain the female housings 1. A cover 3 encloses the wires and double locks the clamping members in the closed condition. In an alternative embodiment the cover itself holds the connector housings in place.

13 Claims, 11 Drawing Sheets

CONNECTOR

TECHNICAL FIELD

The present invention relates to a split electrical connector of a type in which connector housings equipped with metal terminals are inserted and retained in corresponding apertures of a frame.

BACKGROUND OF THE INVENTION

Connectors of a split type are sometimes used in multi-electrode connectors of a kind having for example up to several tens of terminals. Such connectors may prevent erroneous assembly when the metal terminals are inserted in the connector housing.

Split connectors comprise a plurality of connector housings respectively equipped with a small number of metal terminals, and these housings are inserted and clamped in accommodating apertures of a single frame. Furthermore, they have a configuration designed for ease of handling and protection of the inevitably large number of electrical wires which are led out from the housings. These electrical wires are collected together and run in one direction, and a cover is attached to the frame to enclose them. Male and female split connectors are coupled together in use using a coupling member such as a lever or bolt.

As disclosed in Laid Open Japanese Utility Model Application Hei 4-129477, the individual connector housings are inserted and clamped in accommodating apertures of the frame, and a separate retainer is attached to the frame so as to pass through the connector housings once the housings have been inserted against abutment portions, the housings thus being accommodated so that they cannot be removed.

However, these prior art units are disadvantageous because they use retainers which are separate pieces in order to clamp the connector housings in the frame; they thus result in extra production costs and parts management costs, and because they require an extra assembly stage and extra labour, overall prices are inevitably increased.

The present invention aims to provide a connector with a reduced number of parts and which can be made less expensively.

SUMMARY OF THE INVENTION

According to the invention there is provided an electrical connector assembly comprising a frame, an electrical connector removably received within an aperture of the frame and having leads protruding from the rear thereof, and a cover for the frame, said frame and connector including respective abutment surfaces to limit insertion of said connector in the aperture, and said assembly further including a clamping member integral with one of the frame or cover, and engageable with said frame and connector to latch said connector in the frame. Preferably the frame includes a plurality of apertures arranged in a line, one aperture for each of a plurality of connectors. In one preferred embodiment the frame is of plastic and the clamping member comprises a flap connected to the frame by a living hinge and movable from an open to a closed condition when the connector or connectors have been inserted. In such an arrangement the number of components is reduced by moulding the frame and clamping member as one piece.

Preferably two opposite flaps are provided thus ensuring that failure of one flap will not lead to inadvertent disassembly of the connector assembly. Preferably the flaps are symmetrical.

In another preferred embodiment the clamping member comprises said cover for the connector lead. Such a cover is usual but has not hitherto incorporated such a clamping member. In this way also the number of components is reduced by making the cover and clamping member as one piece. Furthermore the clamping operation is performed as the cover is attached rather than as a separate assembly operation.

Preferably the cover is of plastic, and clamping members moulded with the cover comprise ribs engageable directly with the rear face of a connector; in the case of rectangular connectors, said ribs are adapted to engage opposite sides of the connector so as to permit free passage of the associated electrical lead.

Other features of the invention will become apparent from the following description of several preferred embodiments, shown by way of example only with reference to the accompanying drawings in which.

An embodiment in which the invention has been applied to a female-side split connector is now described with reference to FIGS. 1–12.

Figure 1:
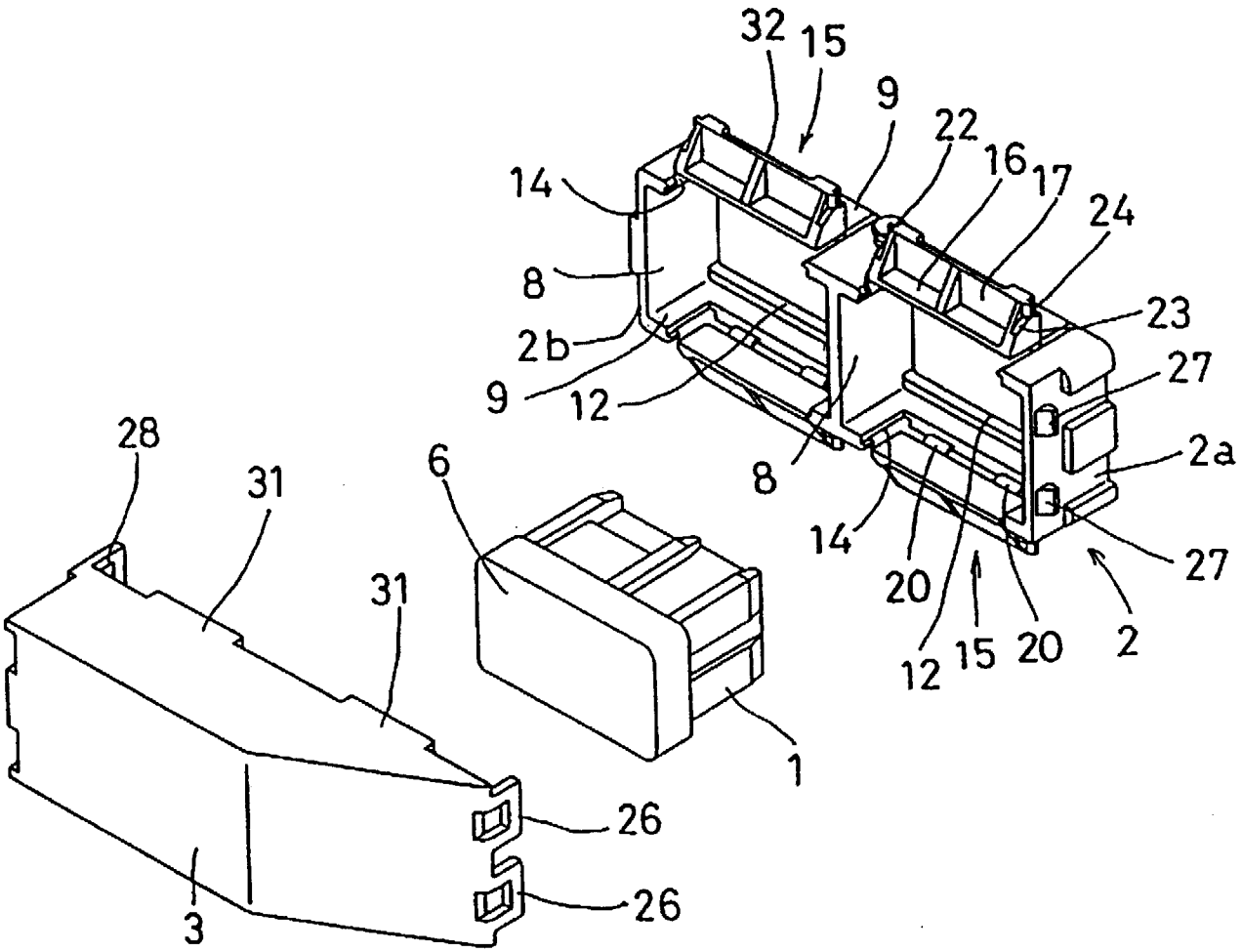
FIG. 1 is an exploded oblique view of a female-side split connector according to one embodiment of the present invention.

As shown in FIG. 1, the female-side split connector of the present embodiment comprises female connector housings 1 (referred to as female housings hereinbelow) equipped with female metal terminals, a frame 2 which accommodates them, and a cover 3 which covers and protects electrical wires 4 led out from the female housings 1.

There are two female housings 1 having external forms which are approximate right-angled parallelepipeds and are formed with thick flanges 6 to the rear in the direction in which they are inserted into the frame 2. Each female housing 1 has formed in it a plurality of cavities (which are not depicted) respectively equipped with female metal terminals, and electrical wires 4 connected to the female metal terminals are led out to the rear of the housings 1 (see FIG. 12).

Figure 2:
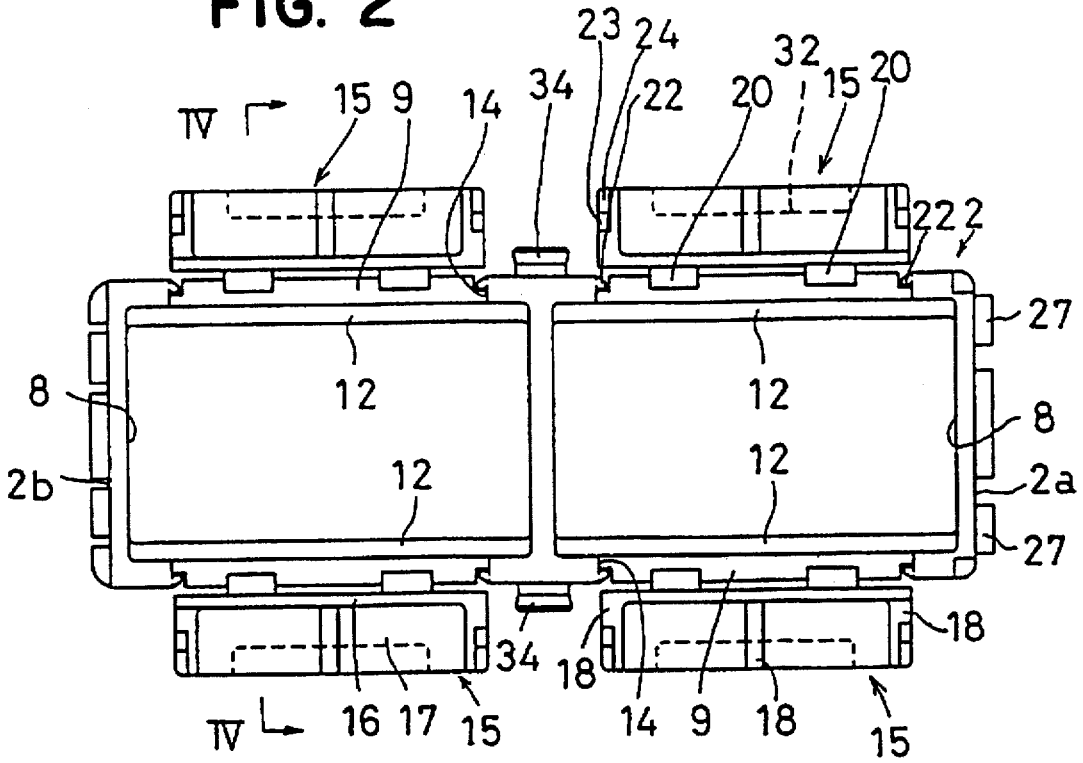
FIG. 2 is a plan view of the frame.

Two accommodating apertures 8 which separately accommodate the above-mentioned female housings 1 are formed in a line in the frame 2. The apertures 8 open from the back to the front of the frame 2, and have an approximately rectangular cross-sectional form in which the flanges 6 of the female housings 1 fit tightly. As shown in FIG. 2, abutment portions 12, against which the front surfaces of the flanges 6 abut, are formed along the front edges of the two side walls 9.

Figure 4:
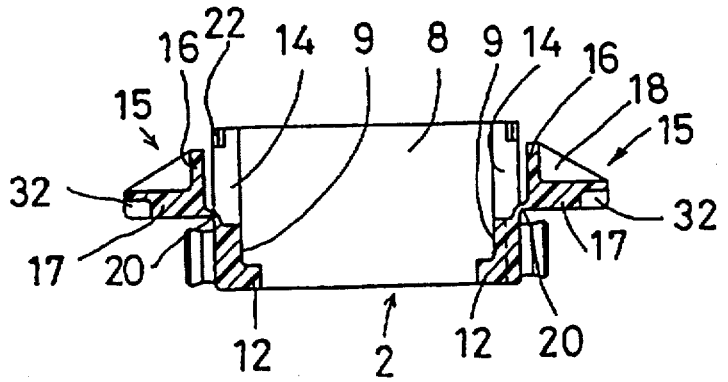
FIG. 4 is a cross-section along the line IV—IV in FIG. 2.
Figure 5:
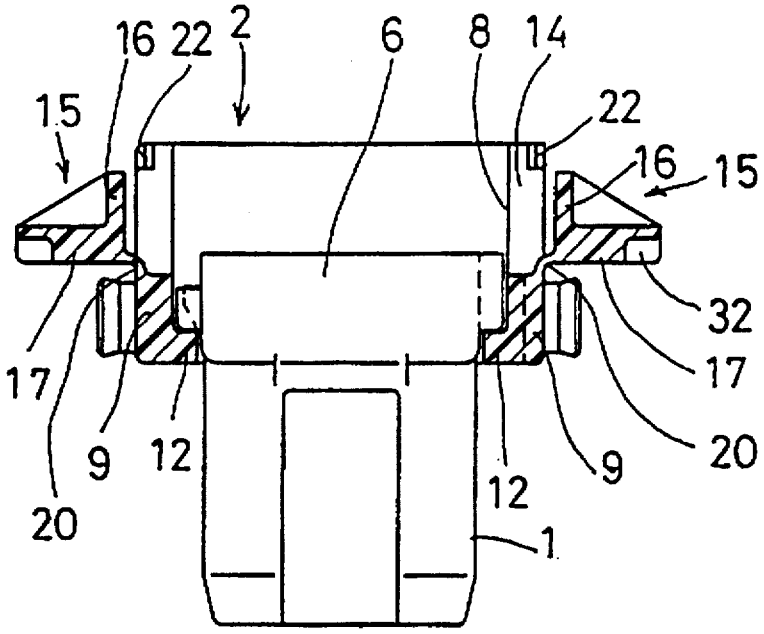
FIG. 5 is a longitudinal cross-section of the female housing inserted in the accommodating aperture.

The two side walls 9 have windows 14, respectively cut away at a fixed depth from the rear edges of the two side walls 9, and a pair of clamping members 15 are provided in the cut-away windows 14. As shown in FIG. 4, the clamping members 15 have a generally L-shaped cross-section with a side plate 17 formed at right angles to one edge of a clamping plate 16; triangular reinforcing plates 18 extend between the two flanges as illustrated.

Figure 3:
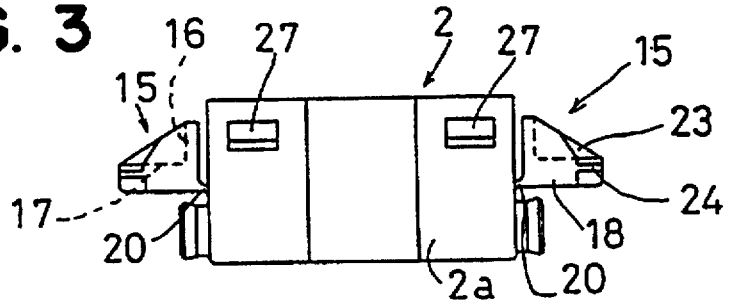
FIG. 3 is a right side elevation of the frame.

As shown in FIGS. 3 and 4, the clamping members 15 adopt a symmetrical configuration in which the side plates 17 are oriented outwards when the clamping plates 16 are oriented in the axial direction of the accommodating apertures 8, and the junction between the respective clamping plates 16 and side plates 17 is connected to the bottom edge of a respective window 14 by a self or living hinge 20 such that the clamping members 15 are integrally formed and able to open and close about the self-hinges 20. In addition, when the two clamping members 15 are pivoted closed so that their side plates 17 are flush in the windows 14, the clamping plates extend into the accommodating aperture 8, projecting from both sides.

As shown in FIG. 2, hooks 22 are provided projecting on the free edges on the corresponding left and right side surfaces of the cut-away windows 14. Clearance recesses 23, which clear the above-mentioned hooks 22 when the clamping members 15 are closed, are formed on the outer surfaces of the reinforcing plates 18 at both ends. Locks 24 are provided at the ends of the said clearance recesses 23 for locking the clamping members 15 in the closed position by riding over the hooks 22 and engaging their insides.

As shown in FIG. 1, a cover 3 is attached covering the rear surface of the frame 2, and one end in its length direction is open while the other end has a slope for clearance when turning a lever (not shown) provided on a companion male split connector.

Figure 8:
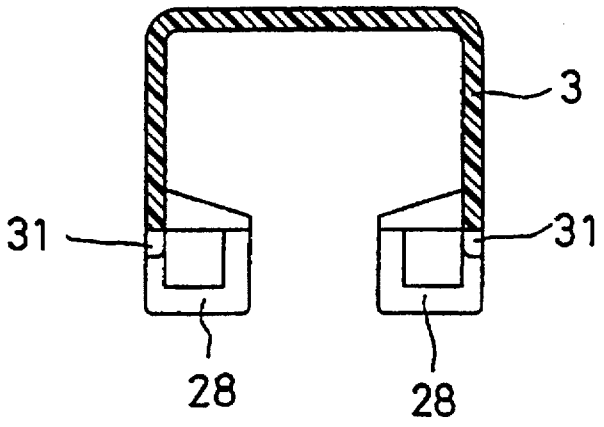
FIG. 8 is a cross-section along the line VII—VII in FIG. 7.
Figure 9:
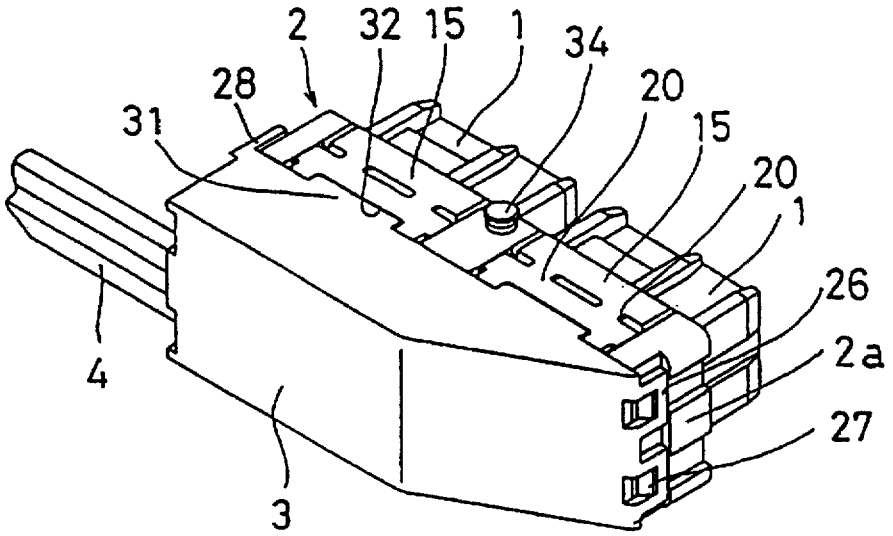
FIG. 9 is an oblique view of the split connector after assembly has been completed.
Figure 10:
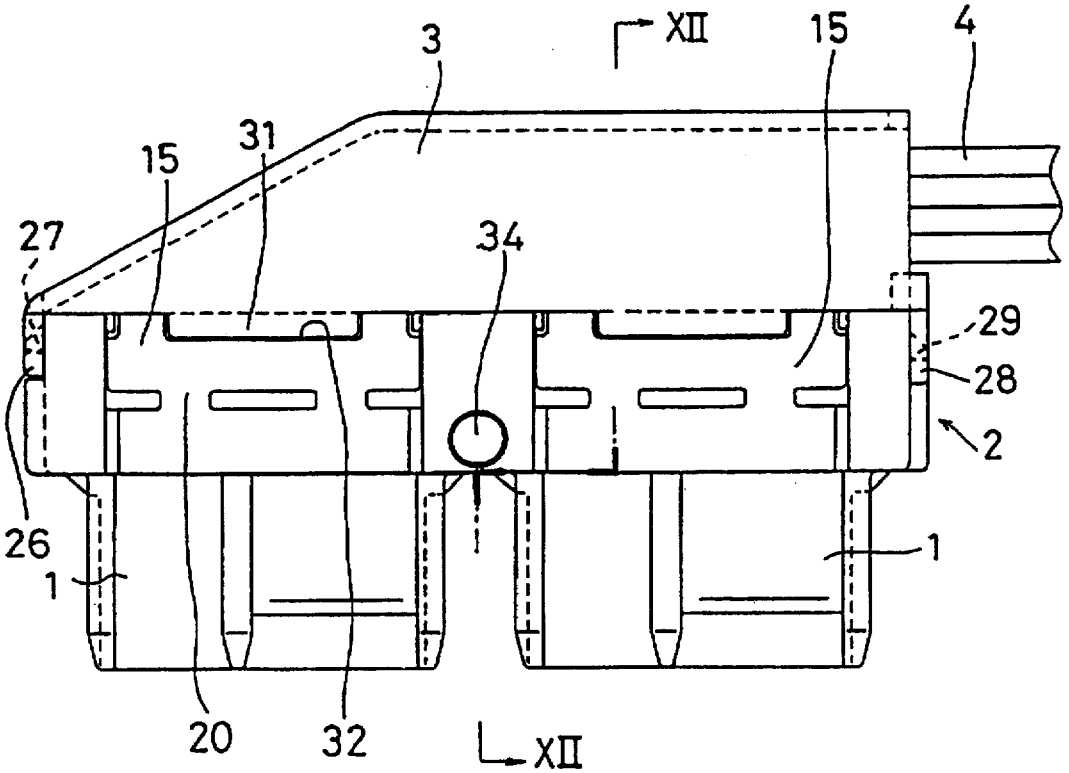
FIG. 10 is a front elevation thereof of the connector of FIG. 9.
Figure 11:
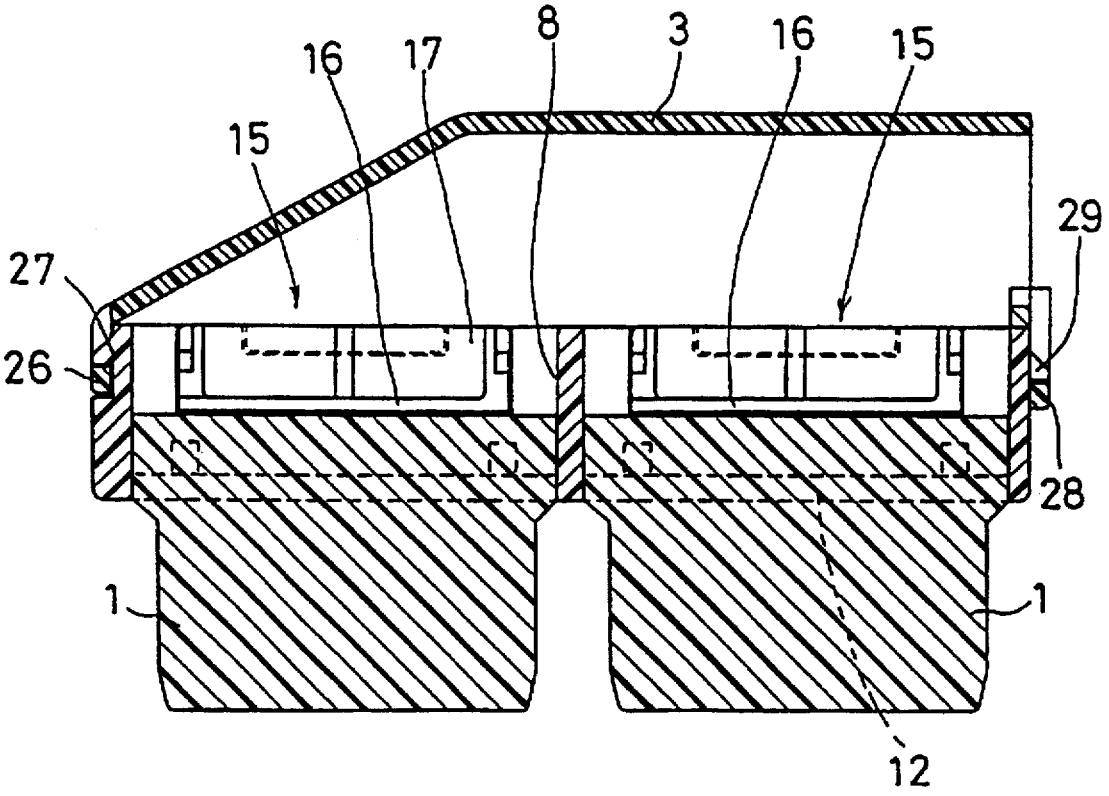
FIG. 11 is longitudinal cross-section through the connector of FIG. 9.
Figure 12:
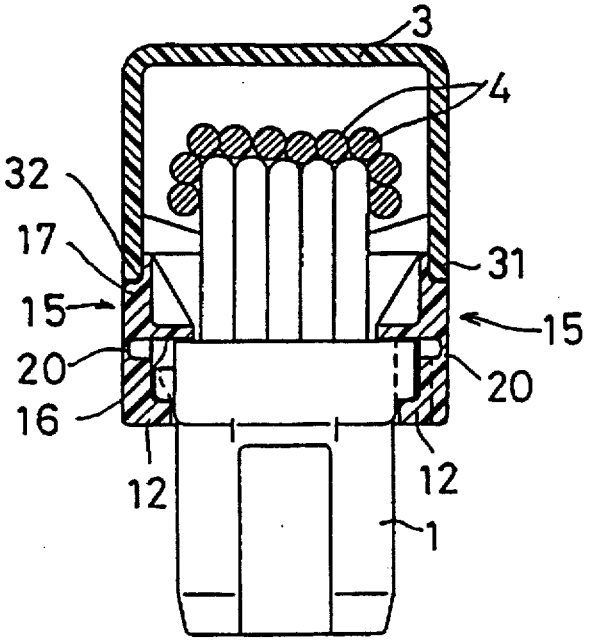
FIG. 12 is a cross-section along the line XII—XII in FIG. 10.

As shown in FIG. 1, first locking structures 26 extend from the sloping end of the cover 3, and corresponding first projections 27 able to engage with these locking structures 26 are provided projecting at the end surface 2*a* of the frame 2. Furthermore, as shown in FIG. 8, two similar locking structures 28 extend from the open side of the cover 3, and corresponding second projections 29 able to engage with these locking structures 28 are provided projecting at the end surface 2*b* of the frame 2.

Two protruding areas 31 are respectively formed on the two edges of the cover 3 where it attaches to the frame 2, these corresponding to the positions where the clamping members 15 are provided on the frame 2. In-fitting recesses 32 into which the protruding areas 31 can fit are formed on the outer sides of the side plates 17 as illustrated.

The component parts of the split connector are moulded in plastic to permit the self hinges 20 to move, and to enable resilient engagement of the locking structures 26, 28 and the respective projections 27, 29.

Operation of this embodiment is now described.

On assembly, the female metal terminals are first respectively fitted into the female housings 1. The four clamping members 15 on the frame 2 are open as shown in FIG. 1. Then the female housings 1 are respectively inserted into the corresponding accommodating apertures 8 of the frame 2, from the rear. The clamping plates 16 do not prevent the housings 1 from being inserted since they are in the retracted condition. The housings 1 are pushed into the respective apertures until they abut against the abutment portions 12. At this time, the front ends of the female housings 1 project out from the front surface of the frame 2.

Figure 6:
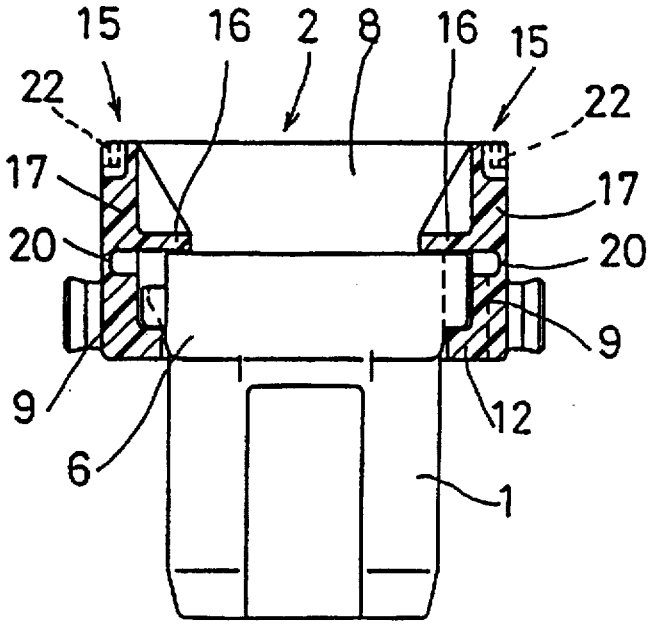
FIG. 6 is a longitudinal cross-section of the clamping member in the closed state.
Figure 7:
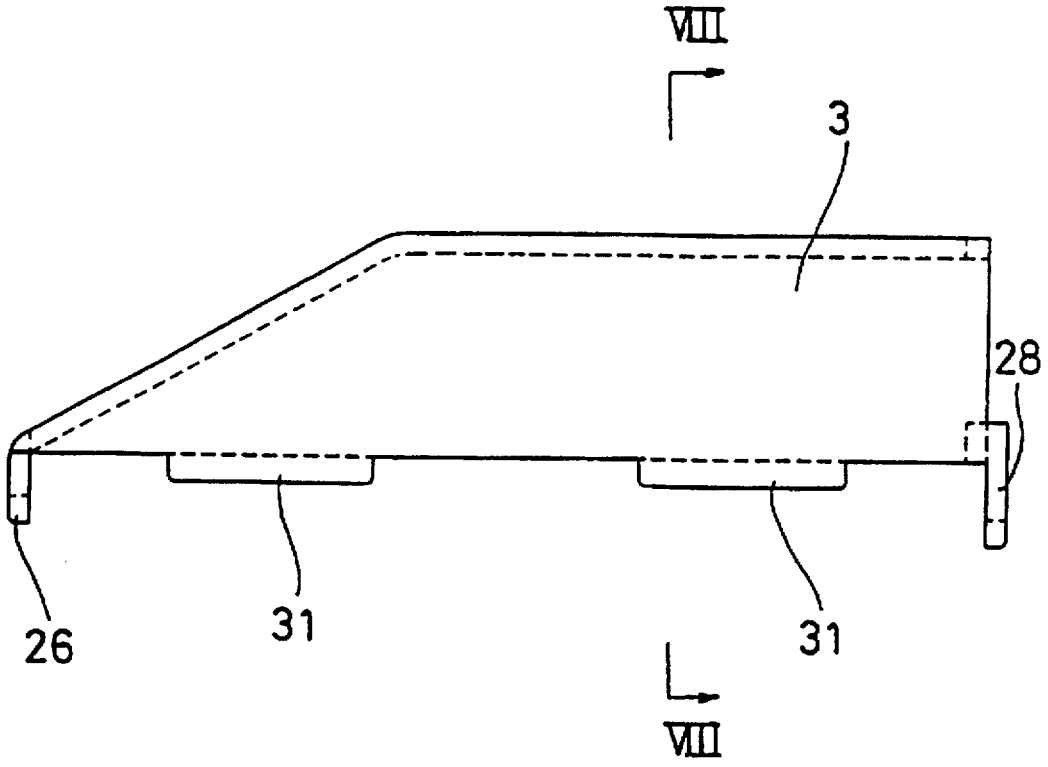
FIG. 7 is a front elevation of the cover.

Once the insertion of the female housings 1 into the two accommodating apertures 8 has been completed, the pairs of clamping members 15 are respectively turned about the self-hinges 20 and closed in such a way as to raise the side plates 17. As the side plates 17 are closed, the hooks 22 of the cut-away windows 14 are cleared by the clearance recesses 23 formed at both ends of the reinforcing plates 18, and, when the clamping members 15 are closed further, the locks 24 ride over the hooks 22 and engage on the inside of them. Thus, as shown in FIG. 6, the clamping members 15 are closed with their side plates 17 in the same plane as the side walls 9 of the frame 2 and completely fitted in the cut-away window 14, and they are retained in this closed state. When two clamping members 15 are closed in this way, the clamping plates 16 project at right angles by a predetermined amount from the sides of the two side walls 9 of the accommodating holes 8 and clamp on to the two end edges of the rear surface of the inserted female housing 1. Thus, the female housings 1 are retained in the apertures 8 against removal.

Then, electrical wires 4 led out from the two female housings 1 are collected and run to one side. The cover 3 is placed at an angle and the first locking structures 26 at one end are fitted and fastened on the first projections 27 on the end surface 2*a* of the frame 2. Next, the open end of the cover 3 is moved towards the frame 2, whereupon the second locking structures 28 are advanced along the end surface 2*b* at the opposite end of the frame 2, and when they have ridden up beyond the second projections 29, the second projections 29 fit into the second locking structure 28. Thus, as shown in FIGS. 9 to 12, the cover 3 is attached to the frame 2, and at this time the projecting areas 31 provided on the attachment edges of the cover 3 fit into the in-fitting recesses 32 of the side plates 17 of the closed clamping members 15, and the clamping members 15 are double-locked in the closed state.

Although not depicted in the figures, two male housings respectively equipped with male metal terminals are similarly accommodated in a male-side frame, and a follower pin 34 provided projecting from the above-mentioned female-side frame 2 is fitted into a cam groove formed in a lever pivotally supported on this male-side frame. Then a levering action caused by turning the lever is used to draw the female-side frame 2 to the male-side frame, engage the corresponding male and female housings with each other and bring the male and female metal terminals with which they are equipped, into contact with each other.

By using pairs of clamping plates 16, it makes it possible to clamp the housings 1 from both sides in a well balanced and robust fashion. Further, the closed state can be reliably maintained by the double lock provided by the projections of the cover 3.

A second embodiment in which the invention has been applied to a female-side split connector is described below with reference to FIG. 13 to FIG. 20.

Figure 13:
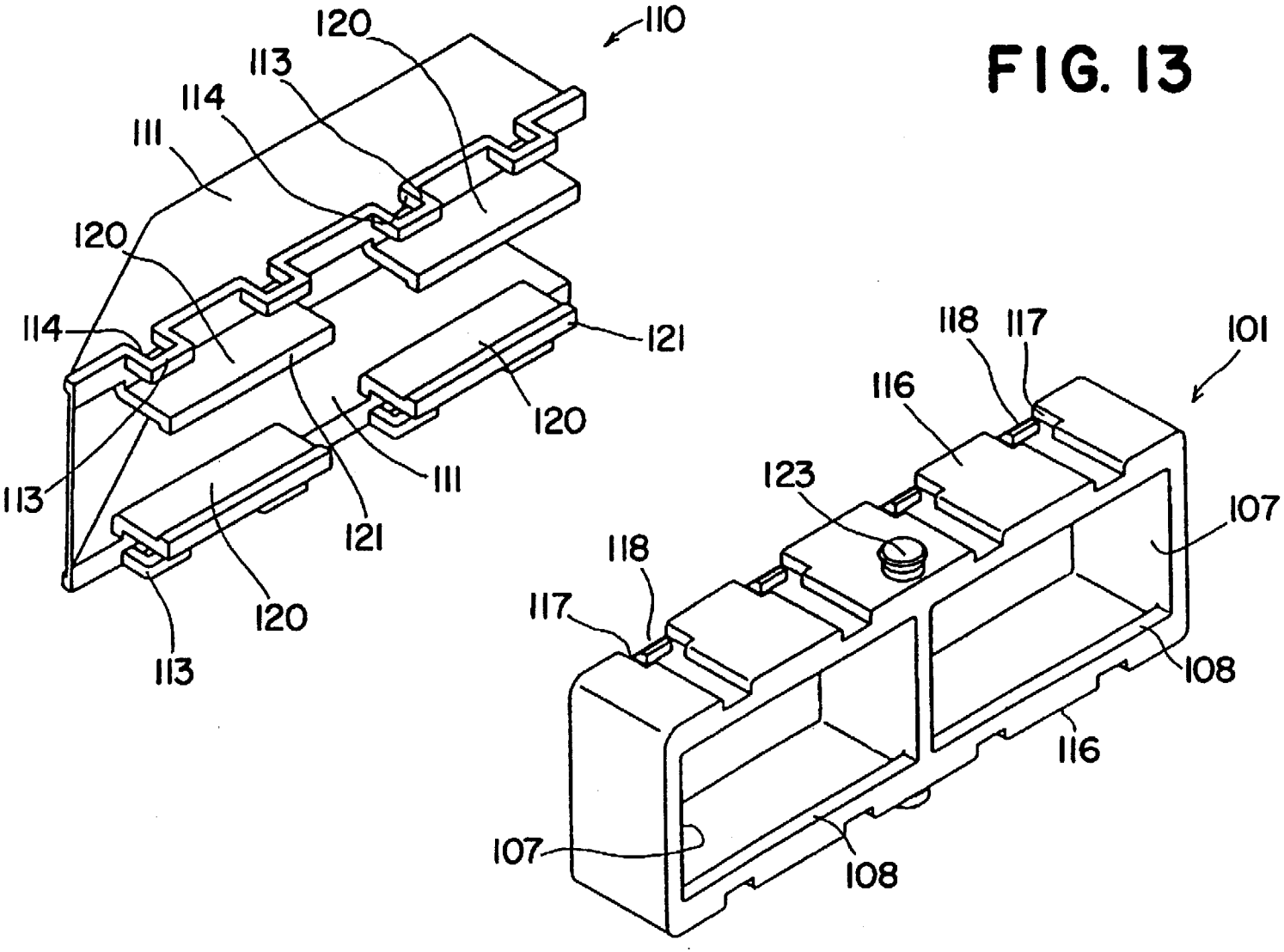
FIG. 13 is an oblique view of a female-side split connector frame and cover according to a second embodiment of the present invention.
Figure 19:
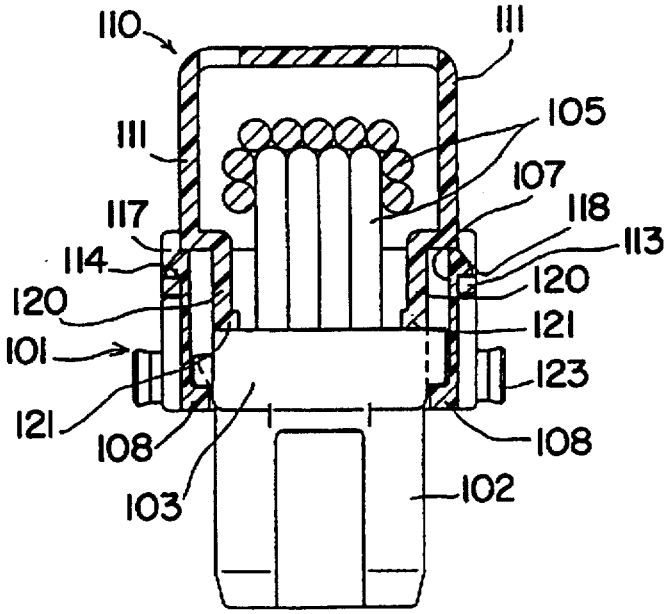
FIG. 19 is a cross-section along the line XIX—XIX in FIG. 18.
Figure 20:
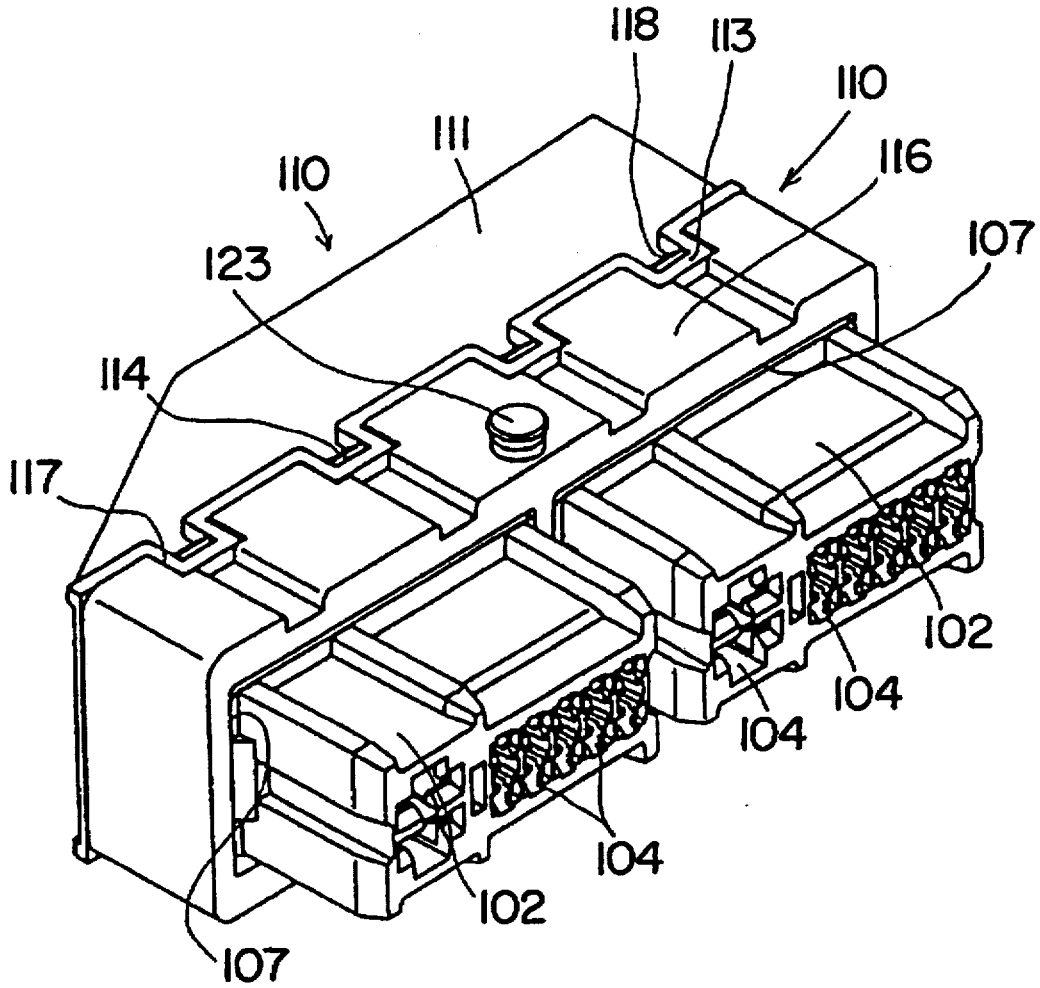
FIG. 20 is an oblique view of the second embodiment after assembly has been completed.

In FIG. 13, the reference 101 denotes a frame which accommodates female connector housings 102 equipped with female metal terminals. As shown in FIGS. 19 and 20, there are two female connector housings 102 (referred to as female housings hereinbelow) which are similar to those of the first embodiment. Each female housing 102 has formed in it a plurality of cavities 104, the insides of which contain female metal terminals, and electrical wires 105 connected to the female metal terminals are led out to the rear.

Figure 14:
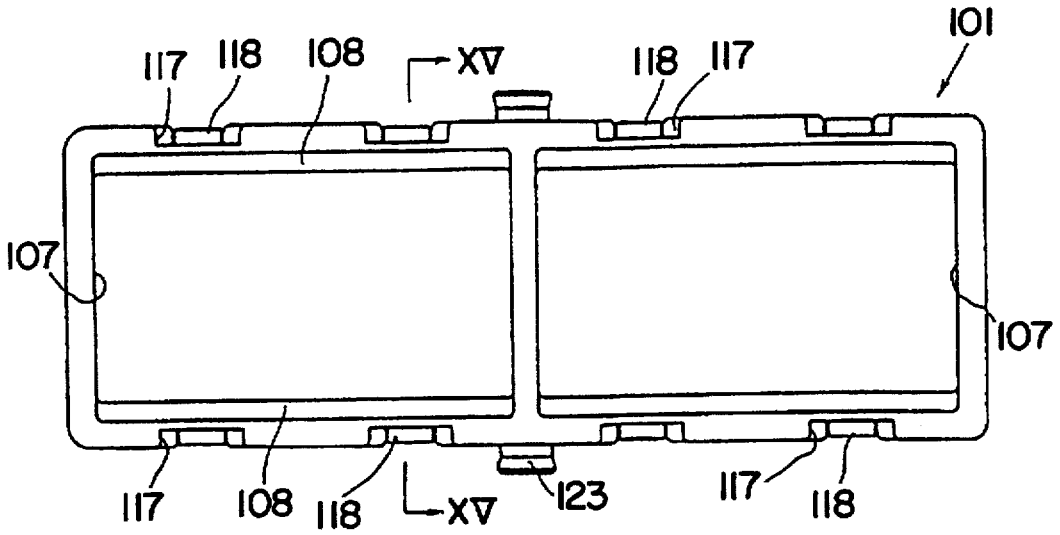
FIG. 14 is a plan view of the frame.
Figure 15:
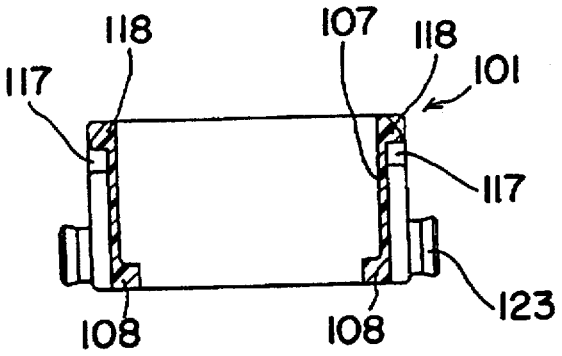
FIG. 15 is a cross-section along the line XV—XV in FIG. 14.
Figure 16:
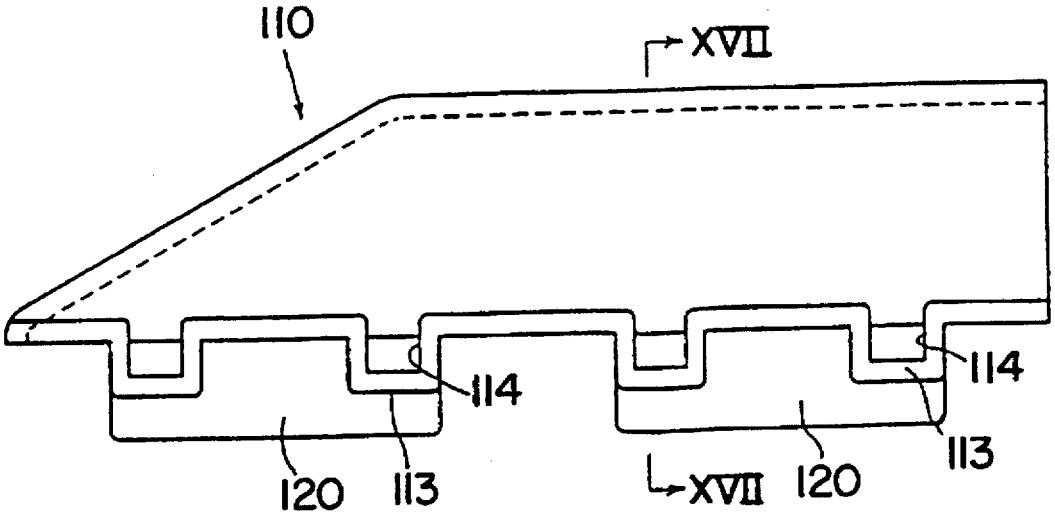
FIG. 16 is a front elevation of the cover.

As shown in FIG. 13 and FIG. 14, two apertures 107 which separately accommodate the female housings 102 are formed in a line in the frame 101. The apertures 107 open from the back to the front of the frame 101, and have an approximately rectangular cross-sectional form in which the flanges 103 of the female housings 102 fit tightly. As shown in FIG. 15 of abutment portions 108 against which the front surfaces of the flanges 103 abut are formed at the front edges of the frame.

In FIG. 3 again, the reference 110 is a cover to be attached to the rear surface of the frame 101, one end in its length direction is open while the other end is formed into a slope for clearance when turning a lever (not shown) provided on a companion male split connector.

Four spaced lock pieces 113 project parallel to the side surface of the cover 110 and have clamping holes 114 as illustrated. The same number of lodging grooves 117 which accommodate the lock pieces 113 are formed in the rear surfaces of the sides 116 of the frame 101, to left and right, and hooks 118 which are able to engage inside the clamping holes 114 are formed in the grooves 117.

Figure 17:
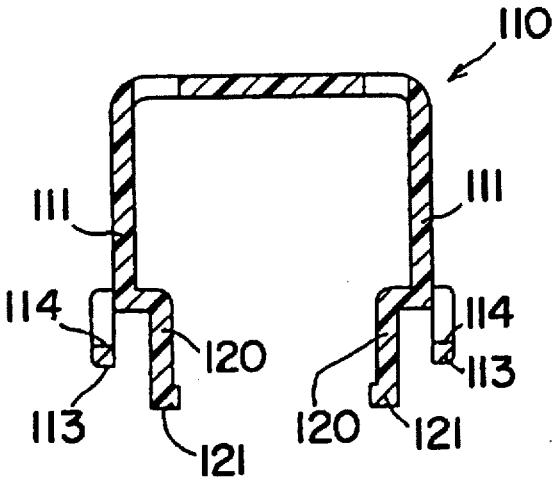
FIG. 17 is a cross-section along the line XVII—XVII in FIG. 16.

A total of four clamping plates or ribs 120 are integrally formed in the above-mentioned cover 110 running along the inside of the lower edges of the left and right side plates 111. Two facing left and right side clamping plates 120 constitute a pair, and each pair of clamping plates 120 functions to respectively clamp a female housing 102 inserted into an accommodating aperture 107. More specifically, as shown in FIG. 17, a pair of clamping plates 120 turn inwards respectively from the bottom edges of the left and right side plates 111 and then project downwards by a fixed amount parallel to the side plates 111, and this projecting edge is formed with a cross-sectional shape incorporating a thick pressing portion 121 at the free end.

The component parts are moulded in plastic as mentioned above.

On assembly, the female metal terminals are first respectively fitted into the female housings 102. Then the female housings 102 are respectively inserted into the corresponding apertures 107, from the rear, until their flanges 103 engage with the abutment portions 108. At this time, the front ends of the female housings 102 project from the front surface of the frame 101.

Figure 18:
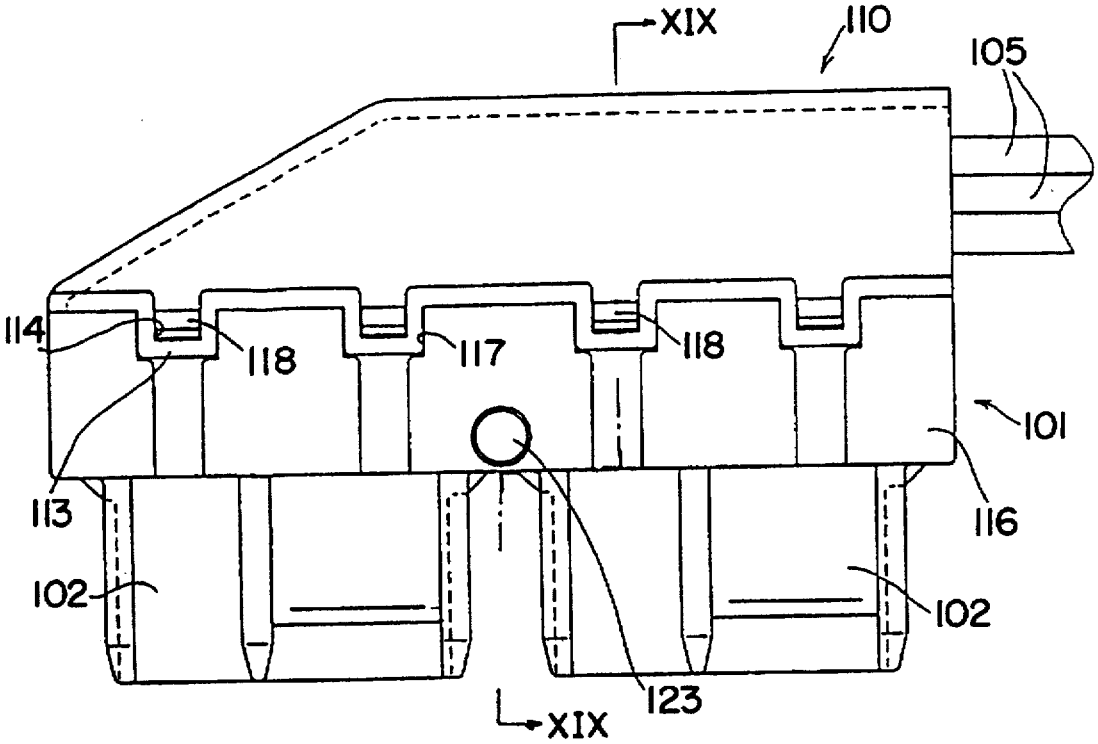
FIG. 18 is a front elevation of the split connector after assembly of the second embodiment has been completed.

Once the insertion of the female housings 102 into the two accommodating apertures 107 has been completed, the electrical wires 105 are collected and run in one direction. Then the lock pieces 113 of the cover 110 are matched with the corresponding lodging grooves 117 and the cover 110 is pushed on; the lock pieces 113 bend outwardly against their resilient force and ride over the hooks 118. When the lower edges of the side plates 111 abut against the rear surface of the frame 101, the clamping holes 114 engage the hooks 118 as shown in FIGS. 18 to 20.

As a consequence, and as shown in FIG. 19, the pressing portions 121 of the pair of clamping plates 120 push on to and clamp against the left and right side edges at the rear of the corresponding female housing, and thus the female housings are accommodated in their corresponding accommodating holes 107 so that they cannot be removed. Furthermore, the electrical wires 105 are covered by the cover 110 and led out from the open end thereof.

Although not depicted in the figures, two male housings respectively equipped with male metal terminals are similarly accommodated in a male-side frame, and a follower pin 123 provided projecting from the female-side frame is fitted to a cam groove formed in a lever pivotally supported on this male-side frame. A levering action caused by turning the lever is used to draw the female-side frame 101 to the male-side frame, engage the corresponding male and female housings with each other and bring the male and female metal terminals, with which they are equipped, into contact with each other.

Thus, because this embodiment is arranged in such a way that the clamping plates 120 which clamp on to the female housings 102 are integrally provided on the cover 110, there are a reduced number of parts, and production costs and management costs are reduced. Furthermore, because the female housings 102 are automatically clamped as a consequence of fitting the cover 110 and there is no need for a separate clamping stage. The pairs of clamping plates 120 clamp the female housings 102 from both sides, in a well balanced and robust fashion.

The present invention is not limited to the above description or to the embodiments described with reference to the figures. Other embodiments are also included in the technical scope of the present invention, and various modifications other than those which follow can also be implemented without departing from the essence of the invention.

In the first embodiment above, the female housings 1 are clamped from both sides using a pair of clamping members 15, but an arrangement may be adopted in which they are clamped on one side only. Furthermore, as was also mentioned in the description of the embodiment above, the present embodiments are not limited to female-side split connectors, and can be applied in similar fashion to male-side split connectors. The present invention is not limited to split connectors, but it can be extensively applied to general connectors of a type in which connector housings are inserted and clamped in accommodating apertures provided in a frame.

We claim:

1. An electrical connector assembly comprising a frame defining at least one aperture, an electrical connector removably received within an aperture of the frame and having a lead protruding from the rear thereof, and a removable cover for the frame, said cover being engageable with and coextensive with said frame to cover said lead, said frame and connector including respective abutment surfaces to limit insertion of said connector in the aperture, said assembly further including a clamping member integral with the frame and engageable with said connector to retain said connector in the frame, and said cover being further engageable with said clamping member in the closed condition and adapted to prevent movement of said clamping member from the closed condition to the open condition.

2. An assembly according to claim 1 wherein said frame includes a plurality of apertures, one each to receive a respective connector.

3. An assembly according to claim 1 wherein said frame is of plastic, and said clamping member comprises a flap connected to said frame by a living hinge and movable from an open to a closed condition.

4. An assembly according to claim 3 wherein said frame is rectangular and a side wall of said frame is cut away to define a rectangular recess, said flap comprising a substantially 'L' shaped member having a first limb flush with said side wall in the open condition and a second limb flush with said side wall in the closed condition.

5. An assembly according to claim 4 wherein said first limb closes at least a portion of said aperture in the closed condition.

6. An assembly according to any of claims 3–5 wherein one of said frame and flap includes a latching member adapted to resiliently engage the other of said frame and flap in the closed condition.

7. An assembly according to claim 6 wherein said latching member is a projection.

8. An assembly according to claim 3 wherein two of said flaps are provided, one each on opposite sides of said frame.

9. An electrical connector assembly comprising a frame defining at least one aperture, an electrical connector removably received within an aperture of the frame and having a lead protruding from the rear thereof, and a cover for the frame, said cover being removably engageable with said frame, said frame and connector including respective abutment surfaces to limit insertion of said connector in the aperture, and said cover further including an integral clamping member engageable with said connector to retain said connector in the frame.

10. An assembly according to claim 9 wherein said clamping member comprises one or more internal ribs of said cover for direct engagement with said connector.

11. An assembly according to claim 10 wherein said connector is rectangular in cross section, a plurality of said ribs engaging opposite outermost edges of said connector.

12. An assembly according to claim 10 wherein said cover is rectangular in section and has two ribs extending parallel to opposite walls of said cover.

13. An assembly according to claim 10 wherein said one or more ribs protrude from the underside of said cover.

* * * * *